United States Patent [19]

Johnson

[11] Patent Number: 4,716,811

[45] Date of Patent: Jan. 5, 1988

[54] DOUBLE TOGGLE GRIPPING APPARATUS

[75] Inventor: Bruce S. Johnson, Dallastown, Pa.

[73] Assignee: Harsco Corporation, Wormleysburg, Pa.

[21] Appl. No.: 694,246

[22] Filed: Jan. 24, 1985

[51] Int. Cl.[4] ..... F41F 3/18

[52] U.S. Cl. ..... 89/40.12; 24/495; 24/513; 269/228; 269/237; 294/115

[58] Field of Search ..... 89/40.12; 294/115; 248/231.5, 316.5; 269/228, 237; 24/494, 495, 513, 568

[56] References Cited

U.S. PATENT DOCUMENTS

| | | | |
|---|---|---|---|
| 1,888,929 | 11/1932 | McDowell | 294/115 |
| 2,155,839 | 4/1939 | Pride | 294/115 |
| 3,425,732 | 2/1969 | Reich | 294/115 |

FOREIGN PATENT DOCUMENTS

| | | | |
|---|---|---|---|
| 2052033 | 4/1972 | Fed. Rep. of Germany | 87/40.12 |

*Primary Examiner*—Frederick R. Schmidt
*Assistant Examiner*—Robert Showalter
*Attorney, Agent, or Firm*—Kerkam, Stowell, Kondracki & Clarke

[57] ABSTRACT

Gripping apparatus for restraining the gun barrel on an armored vehicle comprises a pair of gripping jaws pivotally supported within a housing and connected by a first pair of toggle links to a movable carriage within the housing such that the jaws are opened and closed upon movement of the carriage, a pair of locking members slidably carried on the carriage and adapted to enter apertures in the sides of the housing to lock the carriage at a predetermined location at which the jaws are closed and the toggle links of the first pair are in substantially a straight line relationship, and a second pair of toggle links connected to the locking member and to an actuator rod so as to enable the toggle links of the second pair to assume an over-center position upon the locking members being received in the apertures for positively locking the carriage in the predetermined location.

17 Claims, 6 Drawing Figures

FIG 4
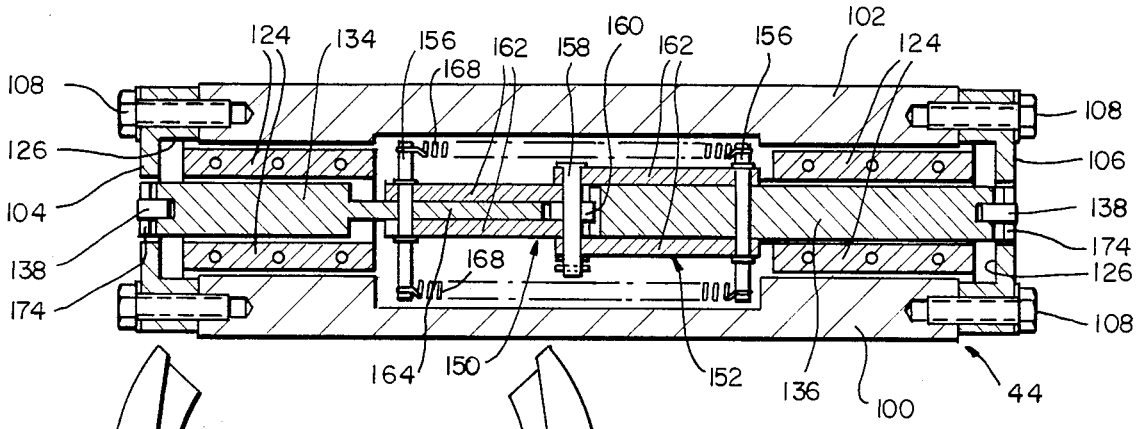
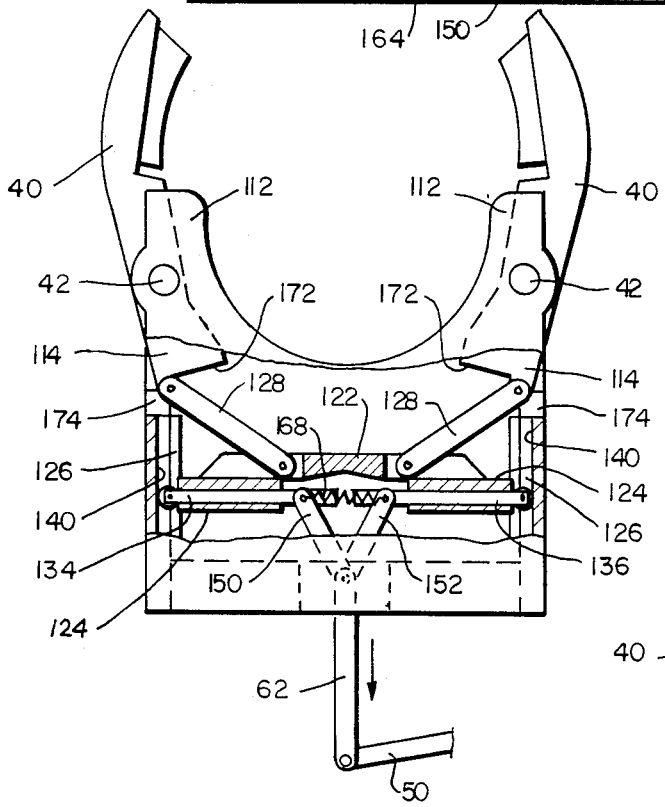
FIG 5
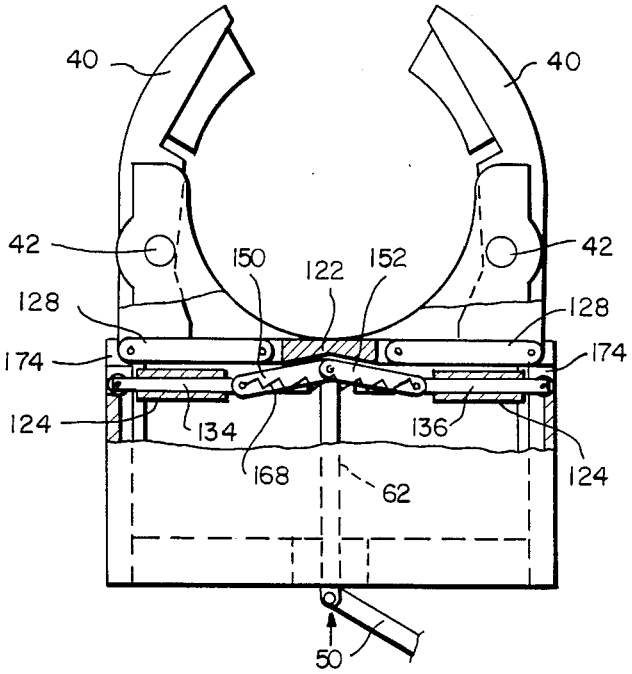
FIG 6

DOUBLE TOGGLE GRIPPING APPARATUS

BACKGROUND OF THE INVENTION

This invention relates generally to locking-type gripping apparatus and devices, and more particularly to positive locking gripping apparatus useful for restraining the gun barrel on an armored vehicle, such as a self-propelled howitzer or tank and the like, during travel.

The barrels of large guns, e.g., artillery pieces, carried on modern combat vehicles and the like are generally fairly long and heavy. To minimize the possibility of damage to either the gun or its steering mechanism, it is desirable to support the gun barrel and restrain its movement when it is not in use during travel of the vehicle. Restraining devices for this purpose must be fairly substantial and capable of securely holding the barrel to prevent it from being jarred about or breaking free when the vehicle traverses rough terrain. Moreover, the restraining device should be capable of being operated remotely to minimize unnecessary exposure of personnel in a combat situation. Although devices are known for restraining the barrels of guns carried on such vehicles, known devices have not been entirely satisfactory, particularly in ensuring positive and reliable locking of the gun barrel in place.

It is desirable to provide improved gripping apparatus which ensures positive and reliable gripping of objects, such as gun barrels on armored vehicles, and it is to this end that the present invention is directed.

SUMMARY OF THE INVENTION

The invention provides improved gripping apparatus which enables positive, reliable and secure gripping of objects, particularly in the presence of large jarring forces on the objects. Apparatus in accordance with the invention has a rather simple construction, is capable of being remotely operated, and may be mounted on a moble or retractable mechanism so that it may be stowed out of the way until it is needed.

Briefly stated, gripping apparatus in accordance with the invention may comprise gripping means pivotally mounted on a structure for movement between opened and closed positions, and a carriage movable on the structure with respect to the gripping means. Toggle linkage means comprising a pair of toggle links connected to the carriage and to the gripping means are included for enabling opening and closing of the gripping means upon movement of the carriage by a carriage moving means. Locking means are carried on the carriage for locking the carriage at a predetermined location on the structure at which the gripping means is closed and at which the pair of toggle links are in substantially a straight line relationship with respect to one another.

More specifically, the invention affords double toggle gripping apparatus which employs first and second pairs of toggle links which operate in series to ensure positive locking and gripping of the object by the pair of gripping members pivotally supported on a housing within which the movable carriage is disposed. The first pair of toggle links operates the gripping members to cause them to close as the carriage is moved toward the gripping members, and the second pair of toggle links is connected to a pair of locking members slidably carried on the carriage transversely to the direction the carriage moves and is connected to a movable actuator rod for moving the carriage. Upon movement of the actuator rod in a direction to move the carriage toward the gripping members, the locking members are forced outwardly by the second pair of toggle links and are received within apertures in the sides of the housing upon the carriage being moved to a predetermined location at which the gripping members are closed and the first pair of toggle links are in substantially a centered or straight line relationship with one another. Upon the locking members entering the apertures, the second pair of toggle links assumes an over-center position, which locks the carriage at the predetermined location. The first pair of toggle links afford a large mechanical advantage to the gripping members so that they grip the object with great force, and the locking members, upon entering the apertures, lock the carriage at its predetermined location to prevent the first pair of toggle links from overtravelling their center position and loosening their grip on the object.

Upon moving the actuator rod in the opposite direction, the second pair of toggle links travel over center in the opposite direction and retract the locking members from the apertures, allowing the carriage to move in a direction to cause the gripping members to open and release the object.

The gripping apparatus of the invention may be advantageously operated by means of a remotely operated actuator mechanism, and may be mounted on a movable structure so that it may be stowed in an out-of-way position when it is not needed. Other advantages and features of the invention will become apparent from the description which follows.

BRIEF DESCRIPTION OF THE DRAWINGS

FIG. 4 is a cross sectional view taken approximately along the lines 4—4 of FIG. 3; and FIGS. 5 and 6 are diagrammatic views illustrating the operation of the gripping apparatus and showing, respectively, the gripping apparatus opened and closed.

DESCRIPTION OF THE PREFERRED EMBODIMENT

Improved gripping apparatus in accordance with the invention is particularly well adapted for use as a gun barrel restraining device on armored vehicles and the like, and will be described in that environment. However, as will become apparent from the description which follows, this is illustrative of only one utility of the invention.

Figure 1:
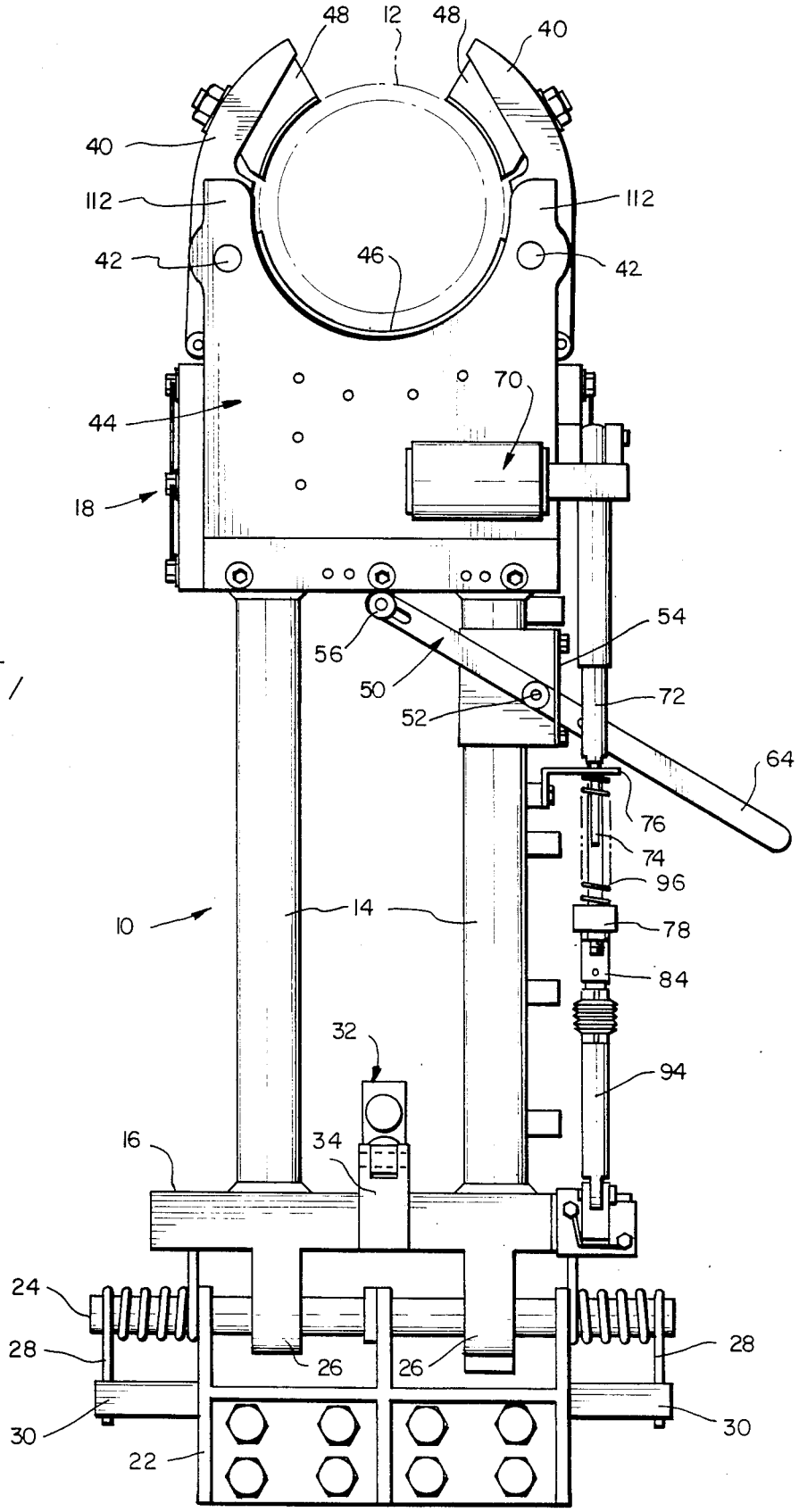
FIG. 1 is a front elevation view of gripping apparatus embodying the invention for gripping a cylindrical object, such as a gun barrel.
Figure 2:
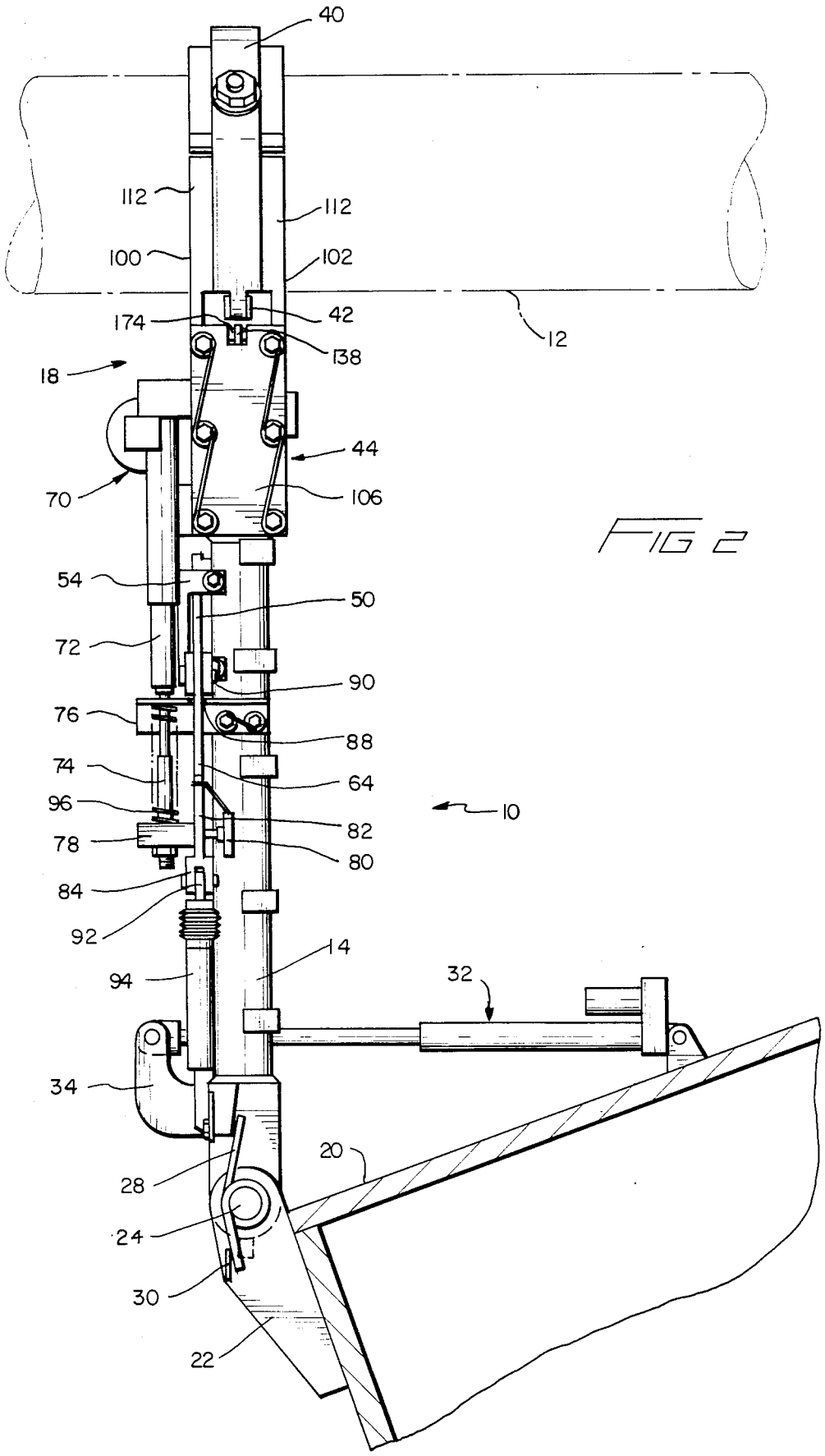
FIG. 2 is a side elevation view of the apparatus of FIG. 1.

FIGS. 1 and 2 illustrate a retractable device 10 embodying gripping apparatus in accordance with the invention for supporting and restraining the movement of a gun barrel 12 of an armored vehicle or the like. As shown, the device may comprise a pair of upright (in the figures) support members 14 having one end connected to a base member 16 and supporting at their opposite end a gripper assembly 18 for gripping and supporting a gun barrel 12. Device 10 may be pivotally supported at its base on the hull 20 of the vehicle, as by a bracket 22 and a shaft 24 which extends through downward projections 26 of base member 16. The device may be biased to an upright position by springs 28 located on the ends of the shaft which engage base member 16 and projecting portions 30 of the bracket. The device may be raised to an upright position for gripping the gun barrel and lowered to a stowed position at which it lies adjacent to the vehicle hull by an actuator mechanism 32 connected to the vehicle hull and to a projecting ear 34 of the base member, as best illustrated in FIG. 2. The actuator mechanism is preferably remotely operated, and may be either electrically, pneumatically or hydraulically powered.

Figure 3:
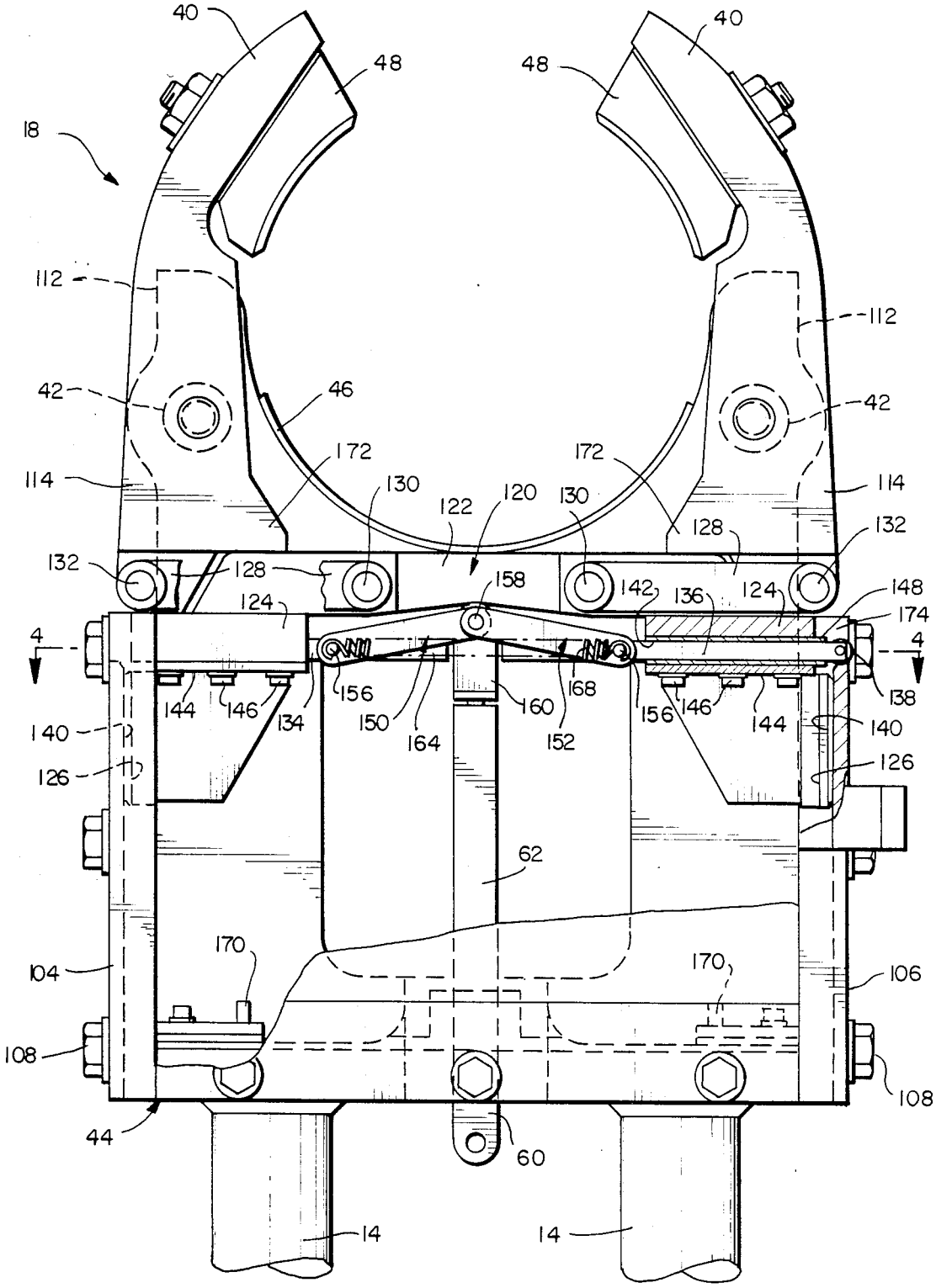
FIG. 3 is an enlarged view partially in cross section and partially broken away of a portion of the apparatus of FIG. 1.

Gripper assembly 18 may comprise a pair of gripping members or jaws 40 which are pivotally supported as by bushings 42 (see FIG. 3) on a structure 44 for movement between an opened and a closed position (the closed position being illustrated in FIGS. 1 and 3). Structure 44 preferably comprises a housing for enclosing the operating mechanism for the gripping members. The housing is supported on the upper ends of support members 14, and is preferably formed with a semicircular saddle portion 46 sized to receive and support the cylindrical gun barrel. Gripping members 40 may carry gripping pads 48 which are suitably contoured to engage the gun barrel when the gripping members are closed, in the manner illustrated in FIG. 1. As will be described in more detail shortly, the operating mechanism for the gripping members comprises two toggle linkages which act in series to ensure positive locking of the gripping members in a closed position at which they securely engage the gun barrel and press it tightly against the saddle. By virtue of its attachment to the vehicle hull, device 10 supports and immobilizes the gun barrel even in the presence of large forces such as are occasioned by the vehicle traversing rough terrain. Prior to describing the construction and operation of the double toggle linkage mechanism, the manner in which this mechanism is actuated will first be described.

Referring to FIGS. 1 and 2, gripping members 40 may be operated via the double toggle linkage mechanism by means of an actuator lever 50 which is pivotally supported, as by a shoulder screw 52, on a slotted lever guide bracket 54 connected to one of the support members 14 (the right support member in FIG. 1). One end of the lever may be slotted and pivotally connected, as by a pin and washer 56, to one end 60 of a movable actuator rod 62 (see FIG. 3) which projects downwardly through the bottom of housing 44. Lever 50 may have an extended portion 64 which projects outwardly from the side of device 10, as shown in FIG. 1. Lever extension 64 constitutes a handle which enables the gripping members to be manually opened and closed, as will be described. To enable remote operation of the gripping members, a remotely operated actuator 70, which may be either electric, pneumatic or hydraulic, may be mounted on housing 44 with a linearly movable piston portion 72 of the actuator disposed adjacent to one side of the right hand (in FIG. 1) support member 14 and such that the piston moves substantially parallel thereto. The piston may be connected to a tie rod 74, which passes through an angled guide bracket 76 connected to the support member and through a guide block 78 connected by means of a screw weldment 80 (see FIG. 2) to a movable link assembly 82 having forked ends 84 and 86. As shown in FIG. 2, the link assembly may pass through a slot 88 in guide 76 and have its right end 86 pivotally connected to handle 64, as by pins and washers as shown at 90. The opposite end 84 of the link assembly may be connected to the movable rod 92 of a conventional damper assembly 94. A compression spring 96 may be disposed concentrically about tie rod 74 so as to extend between the angled actuator guide bracket 76 and guide block 78. Spring 96 biases guide block 78 and link assembly 82 to the left in FIG. 2, which in turn biases lever 50 clockwise with respect to its pivot 52 to the position illustrated in FIG. 1. This position corresponds to the closed position of the clamping members.

Upon lever 50 being pivoted counterclockwise with respect to its pivot from the position illustrated in FIG. 1, actuator rod 62, which operates the double toggle linkage mechanism, is pulled downwardly with respect to housing 44 causing the gripping members to open, as shown in FIG. 5. As previously noted, lever 50 may be pivoted manually by means of handle 64, or remotely by operating actuator 70 to move link assembly 82.

As previously indicated, the double toggle linkage mechanism for operating the gripping members is enclosed within housing 44. As shown in FIG. 4, housing 44 may be formed by front and rear plates 100 and 102, respectively, which are connected together by left and right end plates 104 and 106, respectively, as by bolts 108. As shown in FIGS. 1 and 3, the front and rear plates have upwardly projecting portions 112 at their sides adjacent to the end plates, and have a semicircular cutout portion between the upwardly projecting portions 112 which may receive a curved top plate which forms saddle 46. The gripping members are disposed between the front and rear plates, which support bushings 42 about which the gripping members are pivoted, and the gripping members may have depending leg portions 114 received within the housing.

As best illustrated in FIGS. 3, 5 and 6, a transversely extending cross linkage or carriage 120 is disposed within the housing for vertical movement relative to the gripping members. Carriage 120 may comprise an upper central portion 122 which connects two lower side portions 124 disposed below the central portion. The transverse dimension of the carriage is preferably such that the outer ends of the lower side portions 124 may be slideably received in vertically extending guide slots 126 (see FIG. 4 also) in the end plates of the housing. The carriage carries a first or primary pair of toggle link assemblies 128, each of which may comprise a pair of parallel lever links (only one lever link of each assembly is illustrated in the figures) which are disposed on the front and rear sides of the upper central portion 122 of the carriage. One end of the parallel lever links may be pivotally connected to the central portion of the carriage as by pins 130, and the other end of the parallel lever links may be connected, as by pins 132, to the lower ends of the leg portions 114 of the gripping members received within the housing. Carriage 120 also slidably carries in its lower side portions 124 a pair of transversely extending locking members 134 and 136 which respectively project laterally beyond the left and the right sides of the carriage. The projecting ends of the locking members may carry a roller 138 which is received within a vertically extending groove 140 formed in the left and right end plates of the housing. As shown in FIGS. 3 and 4, the locking members may be slidably disposed within transversely extending guide slots 142 formed in the lower portions of the carriage, the bottom of the guide slots being formed by plates 144 which may be connected to the lower portions, as by bolts 146. As shown in FIG. 3, a suitable lining material 148 may be included within the guide slots to facilitate sliding movement of the locking members therein.

As best illustrated in FIGS. 3–5, the ends of the locking members opposite from the ends which carry rollers 138 project inwardly beyond the lower side portions 124 of the carriage into a space formed below the upper central portion 122. A secondary pair of toggle link assemblies 150 and 152 are pivotally connected to locking members 134 and 136, respectively, by pins 156 which extend through the locking members at intermediate points adjacent to their inner ends, and the secondary toggle link assemblies are pivotally connected together and to the upper end 160 of actuator rod 62 by a pin 158. As shown in FIG. 4, each of the secondary toggle link assemblies preferably comprises two parallel lever links 162 which are disposed on the front and rear sides of the locking members and connected together by pins 156 and 158. The inner end 164 of locking member 134 may have a reduced thickness, as shown, to enable the parallel links to move to an over-center position (the position illustrated in FIGS. 3 and 6), as will be described. The locking members may be biased inwardly toward each other by a pair of springs 168 which extend between the two pivot pins 156, as shown. Springs 168 hold the secondary toggle link assemblies in the over-center position.

The primary and secondary toggle link assemblies operate in series. The primary toggle link assemblies control opening and closing of the gripping members in accordance with the movement of the carriage, and the secondary toggle link assemblies transmit movement of the actuator rod to the carriage and control the locking members. These functions are accomplished in the following manner.

Referring to FIGS. 5 and 6, which respectively illustrate the positions of the carriage and toggle link assemblies for the opened and closed positions of the gripping members, when actuator rod 62 is pulled downwardly by lever 50 toward the position illustrated in FIG. 5, the secondary toggle link assemblies cause the locking members to retract, i.e., move inwardly toward each other, and exert a downward force on the carriage causing it to move downwardly within the housing until it contacts stops 170 (see FIG. 3). As a result of the downward movement of the carriage, the primary toggle link assemblies pull the bottom of the legs of the gripping members inwardly toward each other, causing the gripping members to pivot about bushings 42 and to open. When the actuating rod is pushed upwardly, it pushes directly on the secondary toggle link assemblies, which push outwardly on the locking members. However, outward movement of the locking members is prevented by their engagement with the inner walls of the end plates of the housing, and the upward force on the actuator rod is transmitted to the carriage, causing it to move upwardly within the housing with the rollers 138 on the ends of the locking members rolling up the inside of the end walls within guide slots 140. As the carriage moves upwardly, the primary toggle link assemblies push outwardly on the bottom of the legs of the gripping members and cause the gripping members to pivot about their bushings and to close.

The primary toggle link assemblies afford a large mechanical advantage for pivoting the gripping members closed. As the primary toggle link assemblies move closer to the straight-in-line centered position illustrated in FIGS. 3 and 6, the mechanical advantage afforded by the primary toggle link assemblies increases significantly, causing the gripping members to exert a powerful gripping force on the gun barrel received between the gripping members. The apparatus is preferably designed so as to stop the upward movement of the carriage at a predetermined location at which the primary link assemblies are substantially straight-in-line with each other (as shown in FIGS. 3 and 6) in order to prevent loosening of the grip caused by overtravelling of the primary toggle link assemblies. This may be accomplished, as best illustrated in FIG. 3, by forming the bottom legs of the gripping members with shoulders 172 which engage the upper central portion 122 of the carriage to stop its upward movement. In order to lock the carriage at this position, end plates 104 and 106 of the housing may be formed with apertures 174 which are aligned with the locking members when the carriage is in its uppermost position. Upon the carriage reaching this position, the locking members move outwardly through the aligned apertures 174. This permits the actuator rod to continue moving upwardly until it abuts the underside of the upper central portion 122 of the carriage and permits the secondary toggle link assemblies to move overcenter, as shown in FIGS. 3 and 6. Springs 168 hold the secondary toggle link assemblies in the over-center position with the ends of the locking members which carry the rollers located within the aligned apertures in the end plates, as shown. This locks the carriage assembly in place with the primary link assemblies straight-in-line with each other so that the gripping members grip the gun barrel securely with a great force.

To unlock and open the gripping apparatus, the sequence is reversed. As the actuator rod is pulled downwardly, the secondary toggle link assemblies force the locking members outwardly through the aligned apertures against the bias of the springs, permitting the secondary toggle link assemblies to move downwardly over-center. Continued downward movement of the actuator rod causes the locking members to retract inwardly so that the carriage may be moved downwardly to release the primary toggle link assemblies and open the gripping members, as previously described.

The double toggle mechanism of the invention has a number of significant advantages. In addition to being rather simple in construction, the use of two toggle linkages operating in series ensure that in the closed and locked position the gripping members are positively locked in their tightest gripping position, corresponding to the primary toggle links being centered, by the locking members extending into the apertures in the sidewalls of the housing, and the locking members are positively locked within the apertures by the over-center position of the secondary toggle links. Furthermore, the described construction affords a significant mechanical advantage in translating a rather small actuating force on the actuator rod into a rather large gripping force on the gun barrel by the gripping members, thereby enabling the apparatus to be operated with a rather light actuator mechanism. This is particularly advantageous on an armored vehicle in affording a rather compact gripping mechanism capable of securely restraining the barrel of a gun carried by the vehicle, and in affording a gripping apparatus which may be actuated remotely.

Although the invention has been described in the context of a gripping apparatus for use on an armored vehicle, it will be appreciated by those skilled in the art that the invention is readily adaptable to gripping other cylindrical or non-cylindrical objects, particularly in applications requiring positive locking of the gripping apparatus in closed position and in applications requiring rather substantial gripping forces.

While a preferred embodiment of the invention has been shown and described, it will be appreciated by those skilled in the art that changes may be made in this embodiment without departing from the principles and spirit of the invention, the scope of which is defined in the appended claims.

I claim:

1. Gripping apparatus comprising gripping means pivotally mounted on a structure to open and close; a carriage movable on the structure with respect to the gripping means; toggle linkage means comprising a pair of toggle links connected to the carriage and to the gripping means for opening and closing the gripping means upon movement of the carriage; means for moving the carriage; and locking means carried by the carriage for lockign the carriage at a predetermined location on the structure at which the gripping mens is closed and the pair of toggle links are in substantially a straight line relationship, said locking means comprising locking members slidably carried on the carriage, and wherein the structure has means for receiving the locking members upon the carriage being moved to said predetermined location, and said locking means further comprising another pair of toggle links connected to the locking members and to the moving mans such that the other pair of toggle links assume an over-center position to hold the lock members in the receiving means.

2. The apparatus of claim 1, wherein the other pair of toggle links are formed to assume another position to retract the locking members from the receiving means and enable the carriage to be moved away from said predetermined location.

3. The apparatus of claim 1 further comprising spring means connected to the locking members for biasing the locking members to a retracted position from the receiving means.

4. The apparatus of claim 1 further comprising spring means connected to the toggle links of said other pair for biasing the toggle links to an over-center position.

5. The apparatus of claim 1, wherein each locking member has an end carrying a roller which is received within a guide slot of the structure, and the receiving means comprises an aperture in the guide slot.

6. The apparatus of claim 1, wherein each of the toggle links of said first-mentioned and said other pairs comprises first and second parallel toggle links.

7. The apparatus of claim 1, wherein the gripping means have means for engaging the carriage upon the carriage being moved to said predetermined location to hold the carriage at said location.

8. Gripping apparatus comprising a pair of gripping members pivotally supported on a housing to open and close; a carriage movable within the housing with respect to the gripping members, the carriage slidably carrying a pair of locking members; a first pair of toggle links connected to the gripping members and to the carriage so as to cause the gripping members to pivot upon movement of the carriage; a second pair of toggle links connected to the locking members and to an actuator for moving the carriage; and means within the housing for receiving the locking members upon the carriage moving to a predetermined location at which the gripping members are closed to enable the second pair of toggle links to assume an over-center position to lock the carriage in said predetermined location.

9. The apparatus of claim 8, wherein the first pair of toggle links are connected to the gripping members and to the carriage such that they assume a substantially straight line relationship upon the locking members being received in the receiving means.

10. The apparatus of claim 8 further comprising spring means for holding the second pair of toggle links in said over-center position.

11. The apparatus of claim 8, wherein the locking members are slidably carried transversely on the carriage with respect to the direction of movement of the carriage, and the receiving means comprises apertures in the housing into which the locking members project upon the carriage moving to said predetermined location.

12. The apparatus of claim 11, wherein the locking members each have a roller at one end thereof, which roller is received within a guide slot in the housing.

13. The apparatus of claim 11, wherein the gripping members have means for engaging the carriage to prevent further movement thereof upon the carriage moving to said predetermined location.

14. The apparatus of claim 8, wherein the gripping members comprise gripping jaws which are formed to close upon and tightly grip a cylindrical object received therebetween.

15. The apparatus of claim 14, wherein the apparatus is mounted on an armored vehicle, and said cylindrical object comprises a gun barrel.

16. The apparatus of claim 8, wherein said actuator comprises a remotely operable actuator connected to an actuator rod, the second pair of toggle links being pivotally connected to an end of the actuator rod.

17. The apparatus of claim 8, wherein the housing is formed with guide slots for guiding the movement of the carriage.

* * * * *

UNITED STATES PATENT AND TRADEMARK OFFICE

CERTIFICATE OF CORRECTION

PATENT NO. : 4,716,811

DATED : January 5, 1988

INVENTOR(S) : Johnson

It is certified that error appears in the above-identified patent and that said Letters Patent is hereby corrected as shown below:

In the Abstract, line 12, "member" should be --members--.
Claim 1, line 9, "lockign" should be --locking--.
Claim 1, line 10, "mens" should be --means--.
Claim 1, line 18, "mans" should be --means--.

Signed and Sealed this

Fourth Day of October, 1988

*Attest:*

*Attesting Officer*

DONALD J. QUIGG

*Commissioner of Patents and Trademarks*